US010370934B2

(12) United States Patent
Corre et al.

(10) Patent No.: US 10,370,934 B2
(45) Date of Patent: Aug. 6, 2019

(54) SYSTEMS AND METHODS FOR AN EXPANDABLE PACKER

(71) Applicant: Schlumberger Technology Corporation, Sugar Land, TX (US)

(72) Inventors: Pierre-Yves Corre, Abbeville (FR); Rania El Fadil, Abbeville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 88 days.

(21) Appl. No.: 15/519,707

(22) PCT Filed: Oct. 9, 2015

(86) PCT No.: PCT/US2015/054822

§ 371 (c)(1),
(2) Date: Apr. 17, 2017

(87) PCT Pub. No.: WO2016/069240

PCT Pub. Date: May 6, 2016

(65) Prior Publication Data

US 2017/0247973 A1 Aug. 31, 2017

(30) Foreign Application Priority Data

Oct. 31, 2014 (EP) ..... 14290327

(51) Int. Cl.
*E21B 33/12* (2006.01)
*E21B 33/127* (2006.01)
(Continued)

(52) U.S. Cl.
CPC ..... *E21B 33/1285* (2013.01); *E21B 33/127* (2013.01); *E21B 33/1208* (2013.01); *E21B 47/1025* (2013.01); *E21B 49/083* (2013.01); *E21B 33/12* (2013.01); *E21B 33/122* (2013.01); *E21B 47/10* (2013.01); *E21B 49/08* (2013.01)

(58) Field of Classification Search
CPC ..... E21B 33/1243; E21B 33/127; E21B 33/1277; E21B 33/1285; E21B 49/083
See application file for complete search history.

(56) References Cited

U.S. PATENT DOCUMENTS 1,549,168 A * 8/1925 Townsend ..... E21B 4/18 166/187
4,968,184 A 11/1990 Reid
(Continued)

FOREIGN PATENT DOCUMENTS

WO 2008032045 A1 3/2008

OTHER PUBLICATIONS

International Search Report and Written Opinion issued in the related PCT Application PCT/US2015/054822, dated Jan. 19, 2016 (14 pages).

(Continued)

*Primary Examiner* — Cathleen R Hutchins
(74) *Attorney, Agent, or Firm* — Michael Dae

(57) ABSTRACT

The present disclosure relates to a system that includes a downhole packer assembly that includes an outer skin having a first axial length and an inner packer having a second axial length greater than the first axial length. The inner packer is disposed within the outer skin such that inflation of the inner packer causes the outer skin to expand.

13 Claims, 5 Drawing Sheets

(51) Int. Cl.

| | |
|---|---|
| ***E21B 33/128*** | (2006.01) |
| ***E21B 47/10*** | (2012.01) |
| ***E21B 49/08*** | (2006.01) |
| *E21B 33/122* | (2006.01) |

(56) References Cited

U.S. PATENT DOCUMENTS

| | | | |
|---|---|---|---|
| 2004/0206496 | A1 | 10/2004 | Garcia-Soule et al. |
| 2014/0008061 | A1 | 1/2014 | Corre et al. |
| 2014/0096979 | A1 | 4/2014 | Corre et al. |

OTHER PUBLICATIONS

International Preliminary Report on Patentability issued in the related PCT Application PCT/US2015/054822, dated May 2, 2017 (10 pages).

* cited by examiner

SYSTEMS AND METHODS FOR AN EXPANDABLE PACKER

CROSS REFERENCE

This application claims the benefit of E.P. Application No. 14290327.7, entitled "Systems and Methods for an Expandable Packer," filed Oct. 31, 2014, the disclosure of which is hereby incorporated herein by reference.

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a system that includes a downhole packer assembly that includes an outer skin having a first axial length and an inner packer having a second axial length greater than the first axial length. The inner packer is disposed within the outer skin such that inflation of the inner packer causes the outer skin to expand.

The present disclosure also relates to a method that includes providing a packer assembly having an inner packer disposed within an outer skin, positioning the packer assembly in a wellbore, and inflating the inner packer until the outer skin seals against walls of the wellbore. A first axial length of the outer skin is less than a second axial length of the inner packer.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
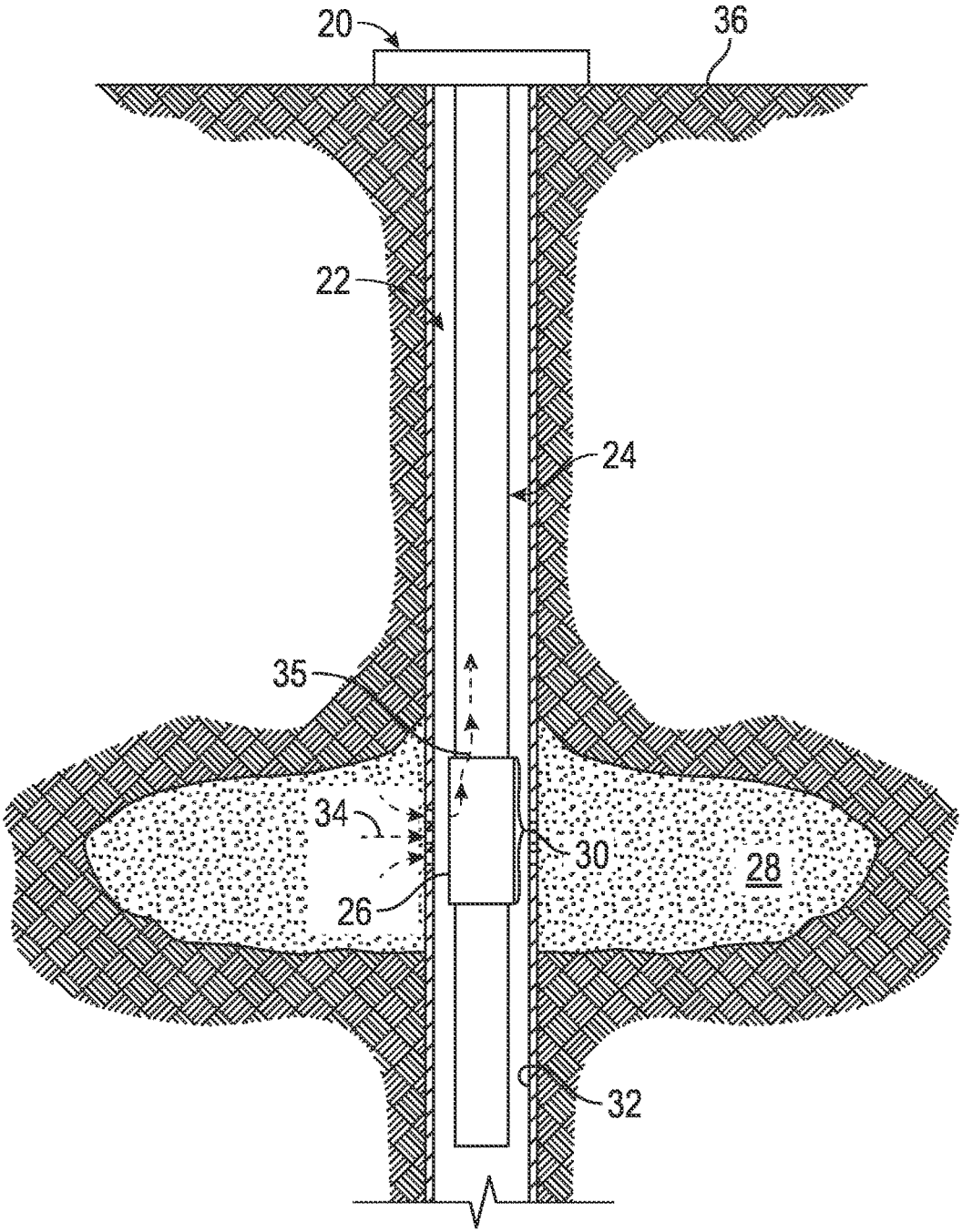
FIG. 1 is a schematic front elevation view of an embodiment of a well system having a packer assembly through which formation fluids may be collected, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for an expandable packer, such as an expandable packer assembly used as part of a downhole tool disposed in a wellbore. In certain embodiments, formation fluid samples are collected through an outer layer of the packer assembly and conveyed to a desired collection location. In addition, the packer assembly may include an expandable sealing element that enables the packer assembly to better support the formation in a produced zone at which formation fluids are collected. In certain embodiments, the packer assembly expands across an expansion zone, and formation fluids can be collected from the middle of the expansion zone, i.e. between axial ends of the outer sealing layer. The formation fluid collected is directed along flowlines, e.g. along flow tubes, having sufficient inner diameter to allow operations in a variety of environments. Formation fluid can be collected through one or more drains. For example, separate drains can be disposed along the length of the packer assembly to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

In certain embodiments, the packer assembly includes several components or layers, such as an outer skin and an inner packer disposed within the outer skin such that inflation of the inner packer causes the outer skin to expand. The outer skin may have a first axial length and the inner packer may have a second axial length greater than the first axial length of the outer skin. Thus, certain portions of the inner packer may not be covered by the outer skin. Accordingly, when the inner packer is inflated, portions of the inner packer may seal against walls of the wellbore in addition to the outer skin. In other embodiments, an articulated protector coupled to the flowlines may block the inner packer from contacting the walls of the wellbore. Accordingly, portions of the outer skin may be confined or blocked from creeping by the portions of the inner packer sealed against walls of the wellbore or the articulated flowline protector. Creeping may refer to the tendency of the material of the outer skin (e.g., rubber or other elastomers) to move slowly or deform permanently under the influence of mechanical stresses, which may be more likely at high temperatures, high pressures, or both. Creeping of the outer skin may degrade performance of the packer assembly. Thus, use of the disclosed embodiments may improve the longevity and durability of the packer assembly in a variety of wellbore conditions by reducing creeping of the outer skin.

Referring generally to FIG. 1, one embodiment of a well system 20 is illustrated as deployed in a wellbore 22. The well system 20 includes a conveyance 24 employed to deliver at least one packer assembly 26 downhole. In many applications, the packer assembly 26 is deployed by conveyance 24 in the form of a wireline, but conveyance 24 may have other forms, including tubing strings, for other applications. In the illustrated embodiment, the packer assembly 26 is used to collect formation fluids from a surrounding formation 28. The packer assembly 26 is selectively expanded in a radially outward direction to seal across an expansion zone 30 with a surrounding wellbore wall 32, such as a surrounding casing or open wellbore wall. When the packer assembly 26 is expanded to seal against wellbore wall 32, formation fluids can be flowed into the packer assembly 26, as indicated by arrows 34. The formation fluids are then directed to a flowline, as represented by arrows 35, and produced to a collection location, such as a location at a well site surface 36. As described in detail below, the packer assembly 26 may be configured such that an axial length of the inner packer is greater than an axial length of the outer skin, thereby reducing creeping of the outer skin.

Figure 2:
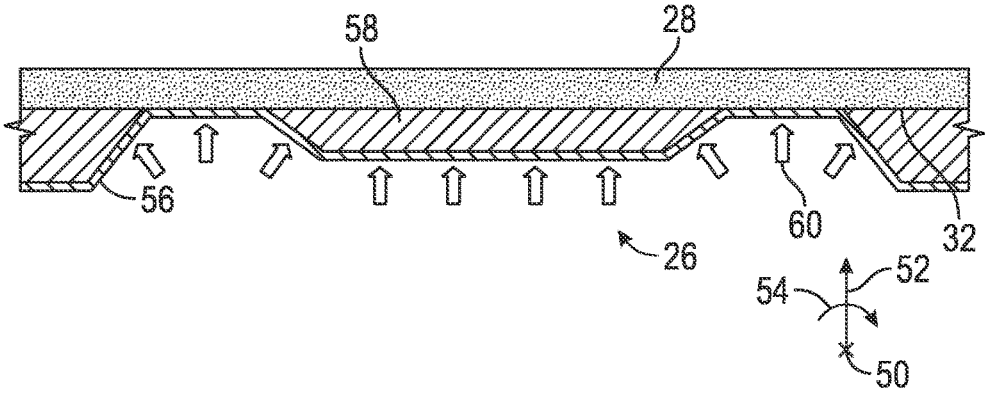
FIG. 2 is a cross-sectional view an embodiment of a packer assembly, according to aspects of the present disclosure.

FIG. 2 is a cross-sectional view of the packer assembly 26, which may have an axial axis or direction 50, a radial axis or direction 52, and a circumferential axis or direction 54. In the illustrated embodiment, portions of an inner packer 56 of the packer assembly 26 are covered by an outer skin 58, but the inner packer 56 is not entirely covered by the outer skin 58. The inner packer 56 may be formed from a variety of materials, such as, but not limited to, rubber and other elastomers. The inner packer 56 may be selectively expanded by fluid delivered via a mandrel coupled to the packer assembly 26. The outer skin 58 may be formed from an elastomeric material selected for hydrocarbon based applications, such as, but not limited to, nitrile rubber (NBR), hydrogenated nitrile butadiene rubber (HNBR), or fluorocarbon rubber (FKM), or any combination thereof. When the fluid is delivered into the inner packer 56, the inner packer 56 may expand in the directions indicated by arrows 60. As shown in FIG. 2, the inflation of the inner packer 56 may cause the outer skin 58 to seal against the wellbore wall 32 of the formation 28. The sealing of the outer skin 58 against the wellbore wall 32 may help direct formation fluid into the drains of the packer assembly 26. In addition, inflation of the inner packer 56 may cause the portions of the inner packer 56 not covered by the outer skin 58 to also contact the wellbore wall 32. In certain embodiments, the inner packer 56 may also seal against the wellbore wall 32. Thus, creeping of the outer skin 58 is blocked by the portions of the inner packer 56 in contact with the wellbore wall 32. In other words, the portions of the inner packer 56 in contact with the wellbore wall 32 block the outer skin 58 from flowing or deforming caused by the high temperatures, high pressures, or both associated with the formation 28.

Figure 3:
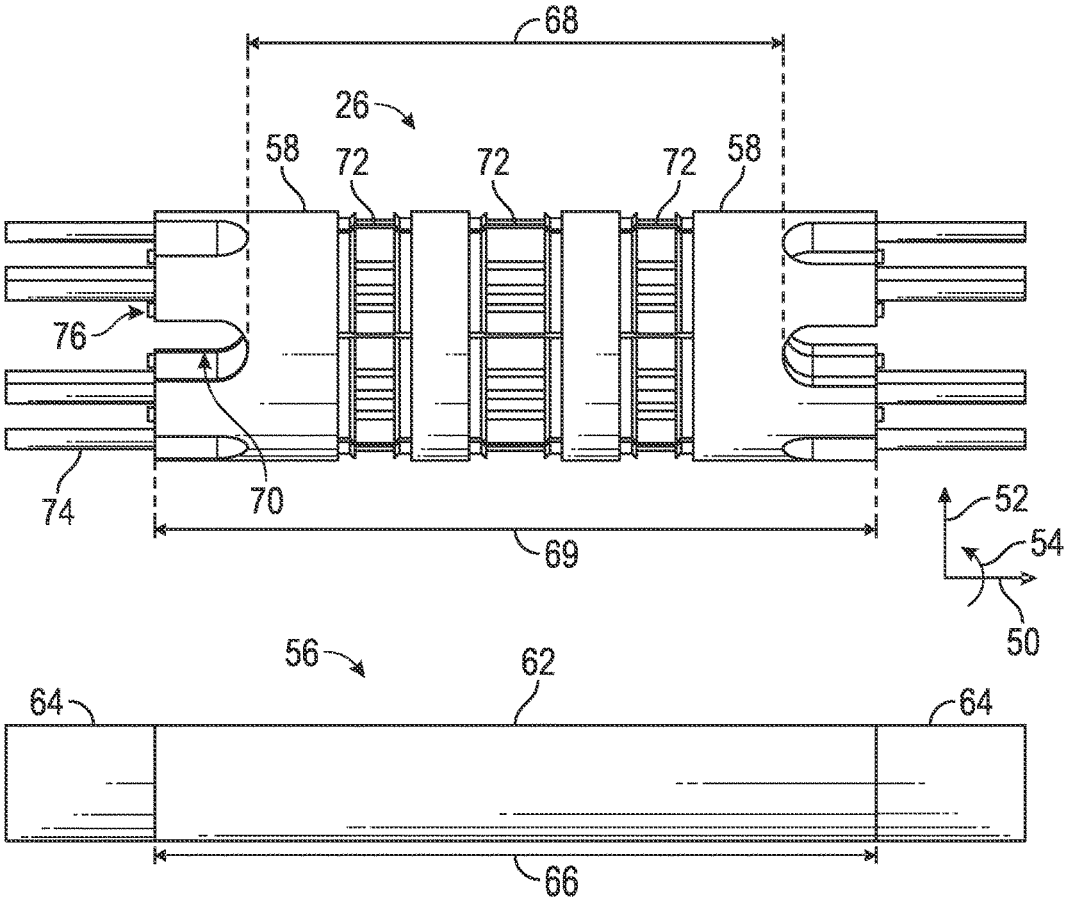
FIG. 3 is a perspective view of an embodiment of a packer assembly with outer skin cutouts, according to aspects of the present disclosure.

FIG. 3 is a perspective view of the packer assembly 26 with outer skin cutouts. For clarity, the inner packer 56 is shown separate from the rest of the packer assembly 26 in FIG. 3. However, during use of the packer assembly 26, the inner packer 56 is disposed within the outer skin 58. In the illustrated embodiment, the inner packer 56 includes an inflatable bladder 62 that is coupled to a tubular end piece or mandrel 64 to define a cavity that may be filled with a pressurized fluid to cause the inner packer 56 to expand and/or press against the outer skin 58. As shown in FIG. 3, the inflatable bladder 62 (e.g., inner packer 56) is defined by an inner packer axial length 66. Similarly, the outer skin 58 is defined by an outer skin axial length 68 where cutouts 70 are formed in the outer skin 58. An overall outer skin axial length 69 of the outer skin 58 is greater than the outer skin axial length 68 at the cutouts 70. In the illustrated embodiment, the inner packer axial length 66 is greater than the outer skin axial length 68 (e.g., axial length where cutouts 70 are formed in the outer skin 58). In other words, the cutouts 70 enable portions of the inner packer 56 to contact the wellbore wall 32 upon inflation of the inner packer 56. In addition, an outer surface area of the inner packer 56 is greater than an outer surface area of the outer skin 58 because of the presence of the cutouts 70 in the outer skin 58. As shown in FIG. 3, several cutouts 70 may be formed circumferentially 54 along the outer skin 58, such as 2, 3, 4, 5, 6, or more cutouts 70. The plurality of cutouts 70 may be spaced circumferentially 54 either uniformly or non-uniformly. In addition, although the cutouts 70 are shown at axial 50 ends of the outer skin 58, in other embodiments, the cutouts 70 may be located at other axial 50 locations of the outer skin 58. When the inner packer 56 is inflated, the cutouts 70 may block the outer skin 58 from creeping into the areas where the inner packer contacts the wellbore wall 32.

In the illustrated embodiment, a plurality of drains 72 are shown between portions of the outer skin 58. The particular arrangement of drains 72 shown in FIG. 3 is one example and is not meant to be limiting. Thus, although the outer skin 58 shown in FIG. 3 includes multiple sections, in other embodiments, the outer skin 58 may be made from one section with openings for the drains 72 and cutouts 70 formed therein. Further, the illustrated embodiment includes a plurality of flowlines 74 coupled to the plurality of drains 72. As shown in FIG. 3, the flowlines extend generally axially 50 away from the outer skin 58 and inner packer 56. In certain embodiments, portions 76 of the flowlines 74 may be embedded within the outer skin 58, thereby protecting the flowlines 74 from contact with the wellbore wall 32, the inner packer 56, or both. In other words, the flowlines 74 may not be located in the same circumferential 54 locations as the cutouts 70.

Figure 4:
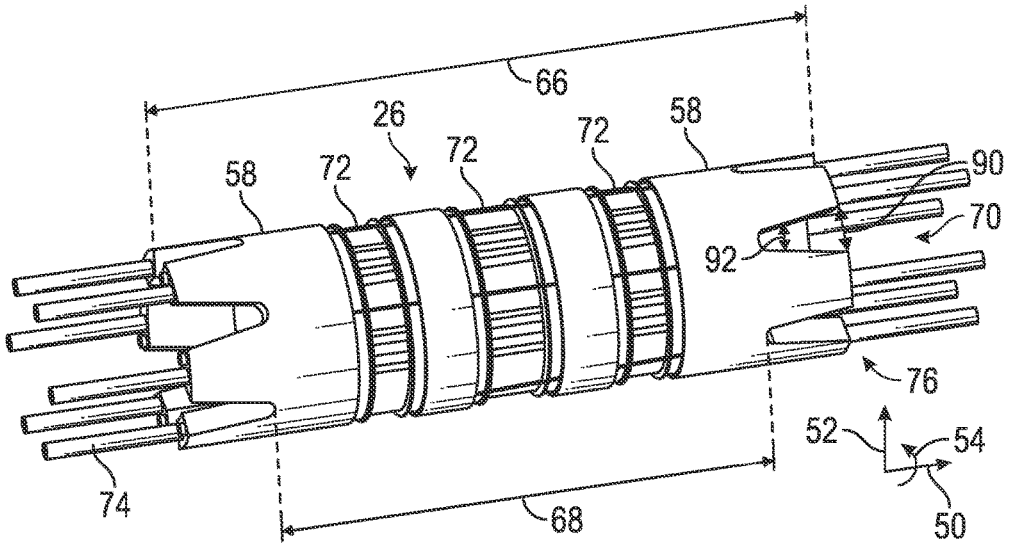
FIG. 4 is a perspective view of another embodiment of a packer assembly with outer skin cutouts, according to aspects of the present disclosure.

FIG. 4 is a perspective view of the packer assembly 26 with the outer skin cutouts 70. In the illustrated embodiment, the shapes of the cutouts 70 are different from that shown in FIG. 3. Specifically, the cutouts 70 shown in FIG. 4 have a tapered shape. In other words, an outer width 90 of the cutout is greater than an inner width 92. Such a shape of the cutout 70 may help reduce stresses experienced by the outer skin 58 during inflation, deflation, or both. Other shapes may be used in further embodiments. Particular shapes of the cutouts 70 may be chosen to provide specific benefits, such as reduced stress, increased durability, decreased debris accumulation, reduced potential for sticking within the wellbore 22, improved performance at particular pressures or temperatures, and so forth. Although one shape is used for the outer skin 58 in the illustrated embodiment, a variety of different shapes may be used in other embodiments. As with the previous embodiments, the inner packer axial length 66 is greater than the outer skin axial length 68 (e.g., axial length where cutouts 70 are formed in the outer skin 58).

Figure 5:
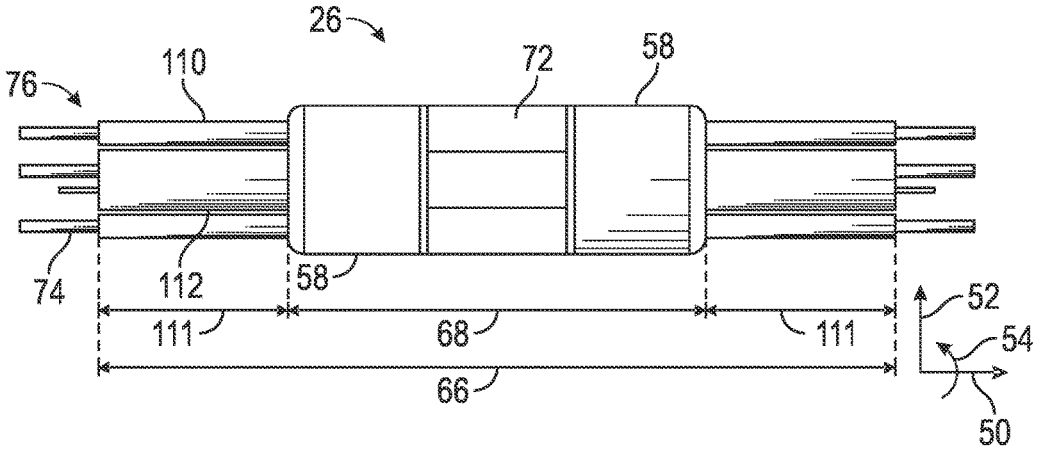
FIG. 5 is a perspective view of an embodiment of a packer assembly with a plurality of flowline protectors, according to aspects of the present disclosure.

FIG. 5 is a perspective view the packer assembly 26 with a plurality of flowline protectors 110 adjacent to the outer skin 58. Portions 76 of each of the plurality of flowlines 74 may be protected by a separate flowline protector 110, which may be made from a rigid material, such as, but not limited to plastic, metal, or any combination thereof. The protected portions 76 of the flowlines 74 may be covered or embedded within the protectors 110. In certain embodiments, one protector 110 may protect more than one flowline 74. As shown in the illustrated embodiment, each protector 110 is defined by a protector axial length 111. As shown in FIG. 5, the inner packer axial length 66 is greater than the outer skin axial length 68. In addition, the inner packer axial length 66 is approximately equal to the sum of the protector axial lengths 111 and the outer skin axial length 68. Thus, inflation of the inner packer 56 may cause the outer skin 58 to seal against the wellbore wall 32 and the protectors 110 to contact the wellbore wall 32. Further, as the inner packer 56 pushes against the protectors 110, the protectors may move apart from one another, thereby increasing the size of gaps 112 between the protectors 110. Thus, the inner packer 56 may extend into the gaps and also contact the wellbore wall 32 in certain embodiments. Thus, the inner packer 56 may help reduce creeping of the outer skin 58. In addition, the protectors 110 also help reduce creeping of the outer skin 58 by confining the outer skin 58.

Figure 6:
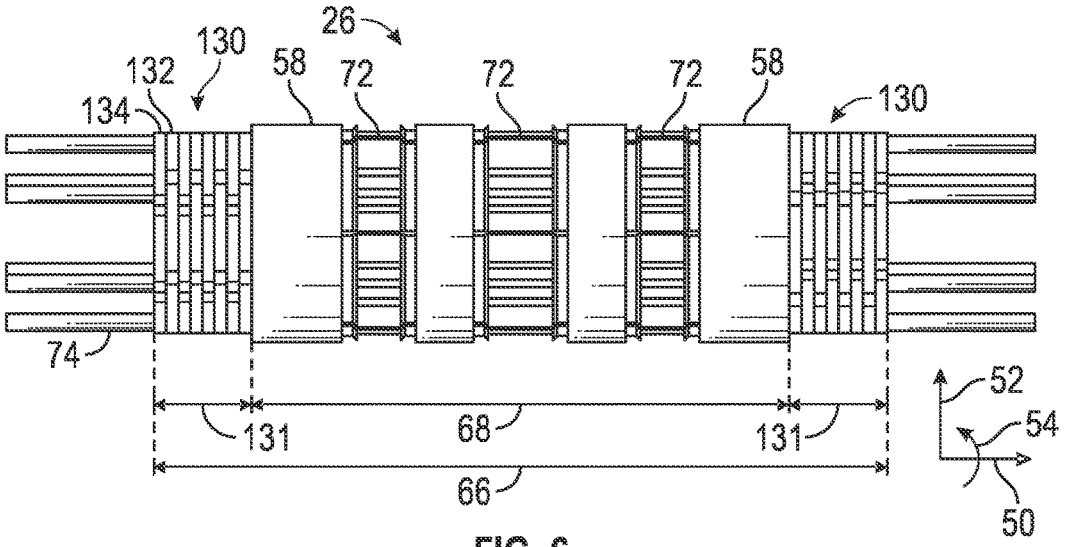
FIG. 6 is a perspective view of an embodiment of a packer assembly with an articulated protector, according to aspects of the present disclosure.

FIG. 6 is a perspective view of the packer assembly 26 with an articulated protector 130, which may protect portions of each of the plurality of flowlines 74. The articulated protector 130 is adjacent to the outer skin 58 and may be made from a plurality of links coupled to one another and arranged in rows. For example, the articulated protector 130 may include a first row of links 132 and a second row of links 134. In certain embodiments, the articulated protector 130 may include a plurality of first and second rows 132 and 134 of links. The protected portions of the flowlines 74 may be coupled to the plurality of links of the articulated protectors 130. As shown in the illustrated embodiment, each articulated protector 130 is defined by an articulated protector axial length 131. As shown in FIG. 6, the inner packer axial length 66 is greater than the outer skin axial length 68. In addition, the inner packer axial length 66 is approximately equal to the sum of the articulated protector axial lengths 131 and the outer skin axial length 68. Thus, inflation of the inner packer 56 may cause the outer skin 58 to seal against the wellbore wall 32 and the articulated protectors 130 to contact the wellbore wall 32. Further, as the inner packer 56 pushes against the articulated protectors 130, the links of the articulated protectors 130 may move apart from one another. However, because of the configuration of the articulated protector 130 (e.g., with the plurality of interconnected links), the inner packer 56 may not contact the wellbore wall 32. Thus, the articulated protectors 130 help reduce creeping of the outer skin 58.

Figure 7:
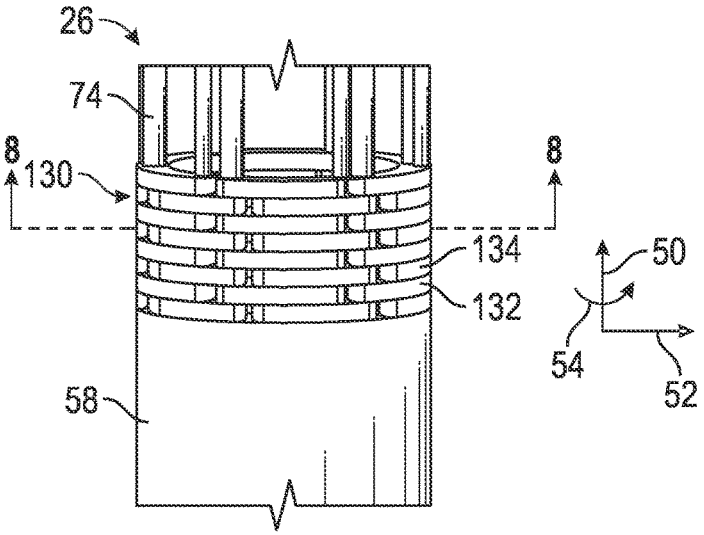
FIG. 7 is a perspective view of an embodiment of a packer assembly with an articulated protector in an uninflated state, according to aspects of the present disclosure.
Figure 8:
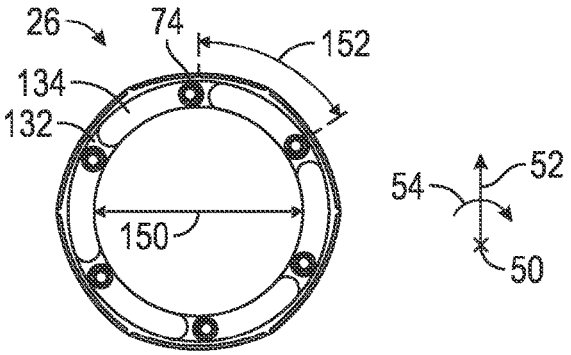
FIG. 8 is a cross-sectional view of an embodiment of a packer assembly with an articulated protector in an uninflated state, according to aspects of the present disclosure.

FIG. 7 is perspective view of the packer assembly 26 with the articulated protector 130 in an uninflated state. As shown in FIG. 7, the links of the articulated protector 130 are adjacent to one another circumferentially 54. FIG. 8 is a cross-sectional view of the packer assembly 26 taken along the line 8-8 of FIG. 7 with the articulated protector in the uninflated state. Again, the links of the articulated protector 130 are adjacent to one another circumferentially 54. In addition, the links are arranged as a ring or annulus with diameter 150 and the flowlines 74 are separated from one another by circumferential distance 152. The diameter 150 is approximately the same as a diameter of the inner packer 56.

Figure 9:
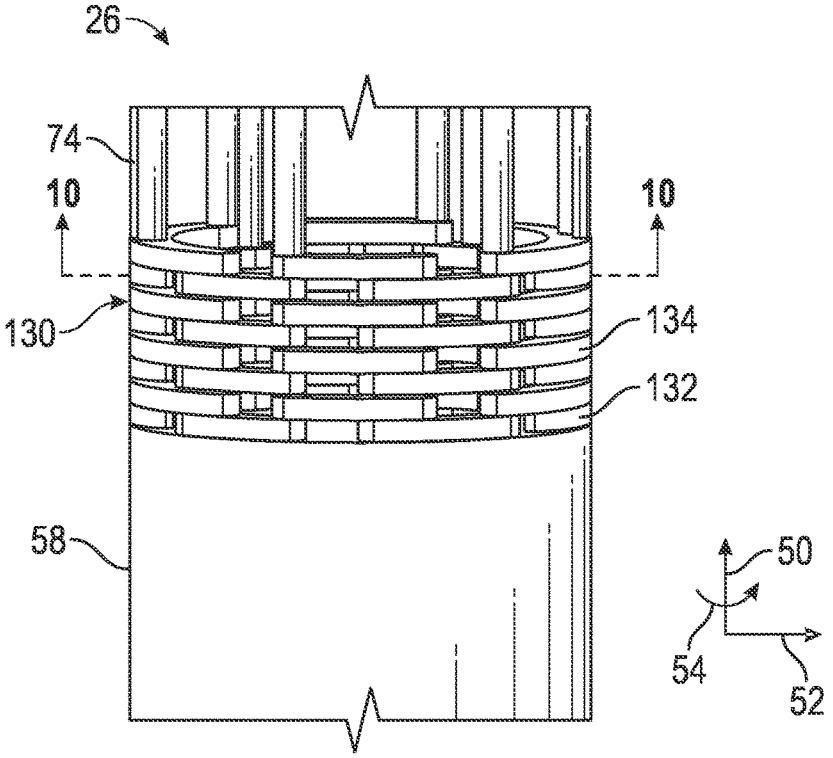
FIG. 9 is a perspective view of an embodiment of a packer assembly with an articulated protector in an inflated state, according to aspects of the present disclosure.
Figure 10:
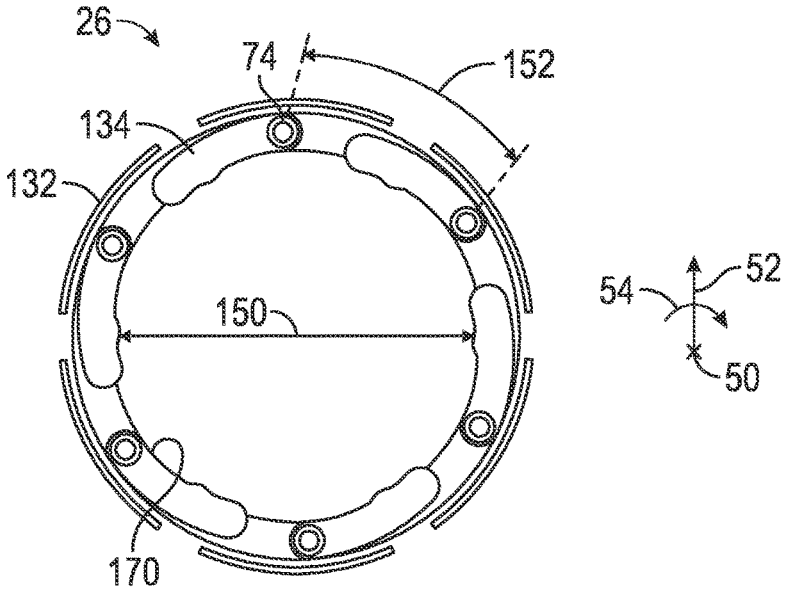
FIG. 10 is a cross-sectional view of an embodiment of a packer assembly with an articulated protector in an inflated state, according to aspects of the present disclosure.

FIG. 9 is perspective view of the packer assembly 26 with the articulated protector 130 in an inflated state. As shown in FIG. 9, the links of the articulated protector 130 are spaced apart from one another circumferentially 54. FIG. 10 is a cross-sectional view of the packer assembly 26 taken along the line 10-10 of FIG. 9 with the articulated protector 130 in the inflated state. Again, the links of the articulated protector 130 are spaced apart from one another circumferentially 54. In addition, the diameter 150 of the links is greater than that shown in FIG. 8 and the circumferential distance 152 is also greater than that shown in FIG. 8. Thus, the articulated protector 130 has expanded in response to the inflation of the inner packer 56. In addition, an interior surface 170 of the articulated protector 130 is generally smooth because of the arrangement of the articulated links, even in the inflated state shown in FIGS. 9 and 10. Thus, the smooth interior surface 170 of the articulated protector 130 helps to protect the inner packer 56 from any negative effects associated with the articulated protector 130.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole packer assembly, comprising:

an outer skin having a first axial length;

an inner packer having a second axial length greater than the first axial length, wherein the inner packer is disposed within the outer skin such that inflation of the inner packer causes the outer skin to expand; and a plurality of flowlines, wherein a first portion of each of the plurality of flowlines is at least partially embedded within the outer skin.

2. The downhole packer assembly of claim 1, wherein a first outer surface area of the outer skin is less than a second outer surface area of the inner packer.

3. The downhole packer assembly of claim 1, wherein the outer skin has the first axial length at a first circumferential location, the outer skin has an overall axial length at a second circumferential location, and the overall axial length is greater than the first axial length.

4. The downhole packer assembly of claim 1, wherein the outer skin comprises a cutout area that exposes a portion of the inner packer when the inner packer is disposed within the outer skin.

5. The downhole packer assembly of claim 1, wherein upon inflation of the inner packer, the outer skin is configured to seal against walls of a wellbore, and at least a portion of the inner packer is configured to contact the walls of the wellbore.

6. The downhole packer assembly of claim 1, comprising a plurality of protectors configured to at least partially cover a second portion of each of the plurality of flowlines not embedded within the outer skin.

7. The downhole packer assembly of claim 6, wherein upon inflation of the inner packer, the plurality of protectors and at least a portion of the inner packer not covered by the outer skin are configured to contact walls of a wellbore.

8. The downhole packer assembly of claim 1, comprising an articulated protector configured to at least partially cover a second portion of each of the plurality of flowlines not embedded within the outer skin, the articulated protector comprising a plurality of links coupled to one another and the plurality of flowlines.

9. The downhole packer assembly of claim 8, wherein upon inflation of the inner packer, the articulated protector is configured to expand, contact walls of a wellbore, and block the inner packer from contact with walls of the wellbore.

10. A method, comprising:

providing a packer assembly having an inner packer disposed within an outer skin, wherein a first axial length of the outer skin is less than a second axial length of the inner packer;

providing the packer assembly with a plurality of flowlines, wherein a first portion of each of the plurality of flowlines is at least partially embedded within the outer skin;

positioning the packer assembly in a wellbore; and inflating the inner packer until the outer skin seals against walls of the wellbore.

11. The method of claim 10, comprising:

providing the packer assembly with a plurality of protectors configured to at least partially cover a second portion of each of the plurality of flowlines; and inflating the inner packer until the outer skin seals against walls of the wellbore, and the plurality of protectors and at least a portion of the inner packer not covered by the outer skin contact walls of the wellbore.

12. The method of claim 10, comprising:

providing the packer assembly with an articulated protector configured to at least partially cover a second portion of each of the plurality of flowlines; and inflating the inner packer until the outer skin seals against walls of the wellbore, and the articulated protector expands, contacts walls of a wellbore, and blocks the inner packer from contact with walls of the wellbore.

13. The method of claim 12, wherein expanding the articulated protector comprises moving each of a plurality of links of the articulated protector circumferentially away from one another.

* * * * *